United States Patent [19]

Kroening

[11] Patent Number: 4,730,147

[45] Date of Patent: Mar. 8, 1988

[54] METHOD AND ARRANGEMENT FOR THE OPERATION OF A GAS DISCHARGE LAMP

[75] Inventor: Armin Kroening, Nussdorf, Fed. Rep. of Germany

[73] Assignee: Siemens Aktiengesellschaft, Berlin and Munich, Fed. Rep. of Germany

[21] Appl. No.: 84,187

[22] Filed: Aug. 12, 1987

[30] Foreign Application Priority Data

Aug. 19, 1986 [DE] Fed. Rep. of Germany ..... 3628013

[51] Int. Cl.[4] ..... H05B 39/04

[52] U.S. Cl. ..... 315/100; 315/104; 315/224; 315/226; 315/DIG. 2; 315/DIG. 5; 315/DIG. 7

[58] Field of Search ..... 315/224, 226, 100, 101, 315/102, DIG. 7, 104, DIG. 2, DIG. 5

[56] References Cited

U.S. PATENT DOCUMENTS 4,647,817 3/1987 Fähnrich et al. ..... 315/100

*Primary Examiner*—Harold Dixon

*Attorney, Agent, or Firm*—Hill, Van Santen, Steadman & Simpson

[57] ABSTRACT

For the operation of warm start gas discharge lamps upon employment of an electronic ballast wherein the gas discharge lamp lies parallel to the effective capacitance of a series-resonant circuit and has its heater coils incorporated into this series-resonant circuit. An isolating switch is provided in series with the effective capacitance. This isolating switch interrupts the shunt to the lamp and, thus, the heater coil current as well, as soon as the lamp has ignited. It is assured in this way that the current flowing in the shunt to the lamp which otherwise represents a dissipated power is suppressed. Particular significance is accorded to this method when the effective capacitance of the series-resonant circuit is executed variably during the starting interval phase with the assistance of temperature-dependent resistors or is executed with time delayed electronic switches for the control of the lamp voltage.

11 Claims, 7 Drawing Figures

METHOD AND ARRANGEMENT FOR THE OPERATION OF A GAS DISCHARGE LAMP

BACKGROUND OF THE INVENTION

The invention is directed to a method, as well as, to arrangements for the operation of a gas discharge lamp provided with heater coils, particularly a fluorescent lamp, whereby a high-frequency ac voltage for operation of the lamp is generated by an inverter from a dc voltage which may be derived from a line ac voltage by rectification. The lamp is arranged parallel to the capacitance of a series-resonant circuit formed of a capacitor and of an inductor which includes the heater coils of the lamp, and whereby, during the heating-up operation of the heater coils (starting interval phase) between the time the power supply is turned on and the lamp is ignited, the voltage applied thereto is limited to a value below its ignition voltage.

Gas discharge lamps requiring a warm start which, upon employment of an electronic ballast, are operated with the high-frequency output voltage of an inverter are generally known. It is thereby important that the voltage appearing at the lamp when the power supply is turned on does not reach the ignition voltage value until the heater coils of the lamp have been adequately heated.

For example, such a warm start gas discharge lamp is disclosed by the reference, European patent specification No. 0 059 064. As disclosed therein, the frequency of the inverter, given the assistance of a control means for turning the supply voltage on, initially operates at a frequency above the resonant frequency of the series-resonant circuit and, toward the end of the starting interval phase, reduces the frequency of the inverter in the direction toward the resonance of the series-resonant circuit such that the voltage at the lamp rises, causing the lamp to ignite.

SUMMARY OF THE INVENTION

An object of the present invention is to improve the operating properties of a warm start gas discharge lamp of the species initially cited with respect to the energy required.

The invention is based on the premise that, after ignition of the lamp, the series-resonant circuit no longer has any significance for the operating lamp and is likewise practically ineffective due to the ignited path of the lamp which represents a shunt to the capacitor. Thus, during the operating condition of the lamp, the current branch containing the capacitor can be disconnected. The current component flowing via the capacitor and effecting dissipated power in the heater coils of the lamp is thereby interrupted and the operating efficiency of the lamp circuit is improved in an advantageous way.

As the reference of European patent specification No. 0 059 064 has already shown to be known, the limitation of the lamp voltage to a value below the ignition voltage during the starting interval phase can also be produced in that, given a rigidly prescribed frequency of the inverter, the resonance curve of the series-resonant circuit is shifted relative to the operating frequency by varying the effective capacitance of the series-resonant circuit so that the lamp voltage does not reach the ignition voltage until the end of the starting interval phase. The possibility of interrupting the current branch parallel to the lamp which includes the capacitor is thereby accorded particular significance, especially when the variation of the effective capacitance is undertaken with the assistance of temperature-dependent resistors or with the assistance of electronic switches.

BRIEF DESCRIPTION OF THE DRAWINGS

The features of the present invention which are believed to be novel, are set forth with particularly in the appended claims. The invention, together with further objects and advantages, may best be understood by reference to the following description taken in conjunction with the accompanying drawings, in the several Figures in which like reference numerals identify like elements, and in which:

DESCRIPTION OF THE PREFERRED EMBODIMENT

Figure 1:
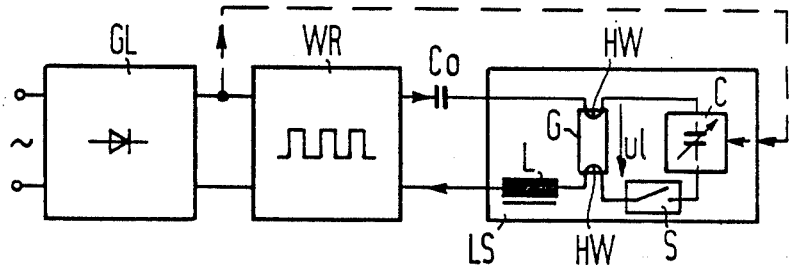
FIG. 1 is a block diagram of the fundamental circuit for a warm start gas discharge lamp using an electronic ballast, a lamp being connected in parallel to a series circuit of an isolating switch and the effective capacitance of a series-resonant circuit.

The fundamental circuit diagram of FIG. 1 for a gas discharge lamp working with an electronic ballast first has at its side at the line voltage, a rectifier circuit GL whose rectified and smoothed line ac voltage at the output side serves as an operating dc voltage for the inverter WR connected thereto. The high-frequency ac voltage of the inverter WR is in turn supplied to the lamp circuit LS via a coupling capacitor Co for the operation of the lamp G.

In addition to the lamp G, the lamp circuit LS has a series-resonant circuit having a variable, effective capacitance C and an inductance L, representing a choke. The heater coils HW of the lamp G are co-incorporated into this series-resonant circuit. The lamp G thereby lies parallel to the effective capacitance C of the series-resonant circuit. In accordance with the invention, the series circuit of the effective capacitance C has an isolating switch S and the series circuit is connected in parallel to the lamp G. The isolating switch S disconnects the effective capacitance as soon as the lamp has ignited.

A broken line in FIG. 1 indicates a control voltage for the effective capacitance C which is thereby the rectified, smoothed ac voltage at the output of the rectifier GL. The control line indicated by a broken line represents one of a number of possibilities of controlling the effective capacitance, which operates as a variable capacitance in this embodiment. This shall be discussed in yet greater detail in combination with the description of the following Figs.

Figure 2:
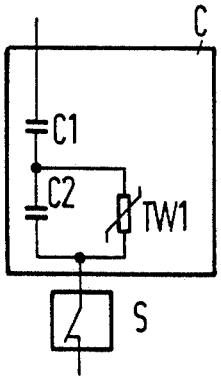
FIG. 2 is a circuit diagram of a preferred, first embodiment of a variable, effective capacitance in series with an isolator switch for use in the FIG. 1 circuit.

In a first, preferred embodiment of the present invention and shown in FIG. 2, a variable, effective capacitance C is connected in series with an isolating switch S for use in a lamp circuit LS of the type shown in FIG. 1. The variable, effective capacitance C is realized by the series connection of a capacitor C1 with a parallel circuit composed of a capacitor C2 and a positive-temperature coefficient resistor TW1. Given employment in the lamp circuit LS, a frequency fz of the inverter relative to a displacement range of the resonance curve of the series-resonant circuit is defined such that the frequency fz always lies above the resonant frequency of the series-resonant circuit.

The function of the lamp circuit LS having the variable, effective capacitance of FIG. 2 shall now be set forth in greater detail with reference to the frequency/-voltage diagram of FIG. 4. When the power supply is switched on, it can be assumed in a first approximation that the resonant frequency of the series-resonant circuit is essentially determined by the capacitor C1 and by the inductor L. Also, when the power supply is switched on, the lamp voltage ul plotted against the frequency f produces a resonance curve for the series-resonant circuit having the resonant frequency fr1. Here, the lamp voltage ul comprises the lamp starting voltage uo, since the frequency fz of the inverter comes to lie relatively far toward the bottom on the upper arm of the resonance curve having the resonant frequency fr1. Furthermore, when the power supply is switched on, the capacitor C2 is practically shorted by the positive-temperature-coefficient resistor TW1 which represents a PTC resistor.

Upon turn-on, the heater coils HW are heated by the current flowing via the series-resonant circuit and via the heater coils HW of the lamp G. At the same time, the positive-temperature-coefficient resistor TW1 is also heated up, so that its value of resistance constantly increases. The result thereof is that, with increasing value of resistance of the PTC resistor, the capacitor C2 in series with the capacitor C1 also has more and more of a determining effect on the resonance of the resonant circuit. This effects a shift of the resonant curve in the diagram of FIG. 4 toward the right, as indicated by the arrow. The result thereof is that the lamp voltage ul increases because the intersection of the frequency fz on the upper arm of the resonance curve shifts farther and farther toward the top until, finally, the lamp voltage ul reaches the lamp ignition voltage uz at which the lamp G ignites. At this point in time, the resonance curve having the resonant frequency fr1 has converted into the resonance curve having the resonant frequency fr2.

As soon as the lamp G has ignited, the series-resonant circuit is generally accorded no further significance in the further operating function. In accordance with the present invention, this situation is utilized for the disconnection of the current arm parallel to the lamp G which contains the variable, effective capacitance C by opening the isolating switch S following the ignition of the lamp and, thus, the dissipated power caused by the current otherwise flowing via this current branch during the operating duration is suppressed.

Figure 3:
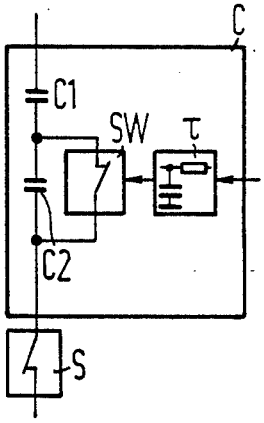
FIG. 3 is a circuit diagram of a modification of the variable, effective capacitance in series with an isolator switch in accord with the FIG. 2 circuit.

A modification of a variable, effective capacitance C in series with an isolating switch S is shown in FIG. 3 and differs from the embodiment of FIG. 2 in that the positive-temperature-coefficient resistor TW1 is replaced by a threshold switch SW. At its control input side, the threshold switch SW is preceded by the time-constant element $\tau$. The control voltage can be supplied to the threshold switch SW via the time-constant element $\tau$ in accord with FIG. 1 via the control line shown there by a broken line. The control voltage is supplied thereto in the form of the rectified ac voltage at the output of the rectifier arrangement GL. When the voltage supply is turned on, the dc voltage takes effect at the control input of the threshold switch SW time-delayed via the time-constant element $\tau$ to such degree that the threshold switch SW does not open and, thus, the capacitor C2 is suppressed until the heater coils HW of the lamp G have been adequately heated up to guarantee the warm start. The sole difference here is that the shift of the resonance curve of the series-resonant circuit from the resonance curve having the resonant frequency fr1 to the resonance curve having the resonant frequency fr2 does not ensue continuously but ensues suddenly in accord with the switching event.

Figure 4:
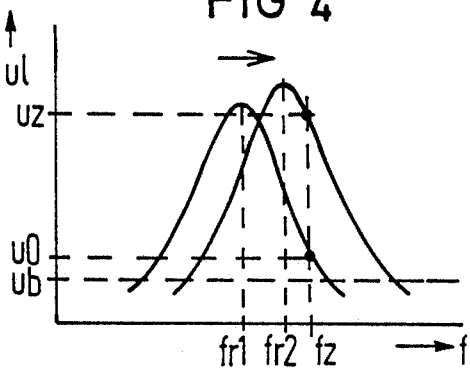
FIG. 4 is a frequency/voltage diagram depicting the resonant curve displacement given employment of variable, effective capacitances in accord with the FIGS. 2 and 3 circuits.
Figure 5:
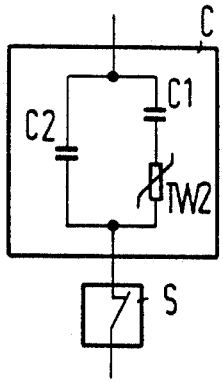
FIG. 5 is a circuit diagram of an alternative preferred embodiment of a variable, effective capacitance in series with an isolating switch in a circuit arrangement for use in the FIG. 1 circuit.
Figure 6:
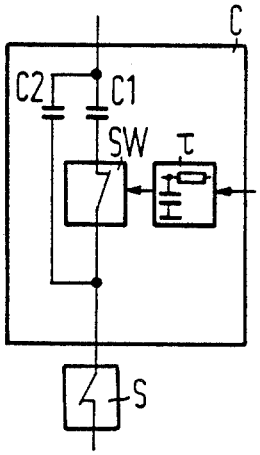
FIG. 6 is a circuit diagram of a modification of the variable, effective capacitance in series with an isolating switch in accord with the FIG. 5 circuit.

Whereas the frequency fz of the inverter in the embodiments of the variable, effective capacitance C of FIGS. 2 and 3, as shown in the frequency/voltage diagram of FIG. 4, always lies above the resonant frequency of the series-resonant circuit, this is reversed in the embodiments of FIGS. 5 and 6. Here, the frequency fz of the inverter always lies below the resonant frequency of the series-resonant circuit.

The variable, effective capacitance of FIG. 5 differs from the variable, effective capacitance C of FIG. 2 only in that the capacitors C1 and C2 are no longer connected in series but rather parallel to one another and the temperature-dependent resistor which lies in series with the capacitor, C1 is a negative-temperature coefficient resistor TW2.

Figure 7:
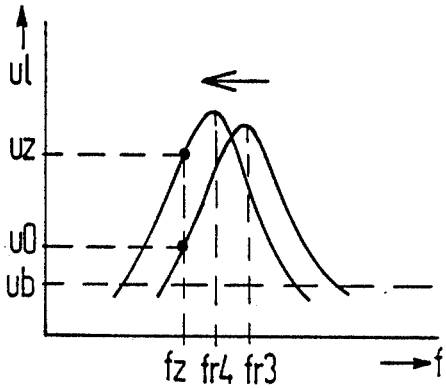
FIG. 7 is a frequency/voltage diagram depicting the resonant curve displacement given employment of variable, effective capacitances in accord with the FIGS. 5 and 6 circuits.

When the power supply is turned on, it is initially only the capacitor C2 which takes effect in a first approximation due to the high resistance of the negative-temperature coefficient resistor TW2. The appertaining resonance curve having the resonant frequency fr3 is shown in the frequency/voltage diagram of FIG. 7. As a result of the current which is now flowing, the negative-temperature-coefficient resistor TW2 is also heated in addition to the heater coils HW, whereby its value of resistance becomes smaller with increasing temperature. This results in placing the capacitor C1 in parallel to the capacitor C2 and becomes more and more of a defining factor for the resonance frequency of the series-resonant circuit. The resonants curve having the resonant frequency fr3 shifts in the direction of the arrow indicated in FIG. 7 toward lower frequencies, and thereby allows the voltage of the lamp starting voltage uo, effective at the lamp due to the ac voltage having the frequency fz, to rise to the lamp ignition voltage uz. When the lamp ignition voltage uz has been reached, the resonance curve in FIG. 7 has the resonant frequency fr4. As soon as the lamp G has ignited, the isolating switch S is opened and, thus, the shunt to the lamp G is eliminated during operation of the lamp.

The modification of the variable, effective capacitance C of FIG. 6 differs from the embodiment recited in FIG. 5 again only in that the negative-temperature-coefficient resistor TW2 has been replaced by the threshold switch SW having the time-constant element τ preceding its control input which is closed for switching the resonance curve.

The isolating switch S can be realized in various ways. A particularly advantageous execution is by use of a four-layer diode which is dimensioned such that its punch-through voltage is situated in its conductive condition in the time span between the turn-on of the power supply and the ignition of the lamp G and is situated in its inhibited condition in the operating condition of the lamp G.

It is also conceivable to make the control of the isolating switch S dependent on whether the lamp G emits light or not. In this case, the isolating switch would be composed of a circuit arrangement controlled by an opto-electronic semiconductor transducer, being composed, for example, of the combination of a phototransistor and of a switching transistor.

The recited method for the operation of a gas discharge lamp, including the specific lamp circuits specified for this purpose, can be advantageously applied in all warm start low-pressure gas discharge lamps.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. A method for the operation of a gas discharge lamp provided with heater coils, particularly a fluorescent lamp, whereby a high-frequency ac voltage for operating the lamp is generated with an inverter from a dc voltage which is derived from a line ac voltage by rectification, said lamp being thereby arranged parallel to an effective capacitance of a series-resonant circuit formed of an effective capacitor and of an inductor and which includes the heater coils of the lamp, and whereby, during the heating-up operation of the heater coils (starting interval phase) between the turn-on of the power supply and the ignition of the lamp, the voltage adjacent thereto is limited to a value below the lamp's ignition voltage, said method comprising the steps of:

following the ignition of the lamp, suppressing the series-resonant circuit by interrupting a current branch having the effective capacitance and lying parallel to the lamp, said interruption affected by means of an isolating switch; and suppressing the series-resonant circuit as long as the lamp is in operation.

2. The method described in claim 1, wherein the inverter operates with a fixed frequency; and wherein the effective capacitance at the beginning of a starting interval phase has a value at which the frequency difference between the resonant frequency of the series-resonant circuit and the frequency of the inverter causes the lamp voltage to be below the ignition voltage of the lamp; and wherein the effective capacitance is continuously varied during the starting interval phase in the sense of reducing the frequency difference or, respectively, in the sense of increasing the lamp voltage to the lamp ignition voltage.

3. The method described in claim 1, wherein the inverter operates with a fixed frequency; and wherein the effective capacitance at the beginning of the starting interval phase has a value at which the frequency difference between the resonant frequency of the series-resonant circuit and the frequency of the inverter causes the lamp voltage to be below the ignition voltage of the lamp; and wherein the effective capacitance is discontinuously varied at the end of the starting interval phase in the sense of reducing the frequency difference or, respectively, in the sense of increasing the lamp voltage to the lamp ignition voltage.

4. An electronic circuit for the operation of a gas discharge lamp provided with heater coils, particularly a fluorescent lamp, whereby a high-frequency ac voltage for operating the lamp is generated with an inverter from a dc voltage which is derived from a line ac voltage by rectification, said lamp being arranged parallel to an effective capacitance of a series-resonant circuit formed of an effective capacitor and of an inductor and which includes the heater coils of the lamp, and whereby, during the heating-up operation of the heater coils (starting interval phase) between the turn-on of the power supply and the ignition of the lamp, the voltage adjacent thereto is limited to a value below its ignition voltage, said electronic circuit comprising:

a current branch representing the variable, effective capacitance in series with an isolating switch, said current branch having a series connection of a first capacitor with a parallel circuit having a second capacitor and a positive-temperature-coefficient resistor;

wherein following the ignition of the lamp, the series-resonant circuit is suppressed by interrupting the current branch comprising the effective capacitance and lying parallel to the lamp, said current branch being interrupted by means of the isolating switch and remaining suppressed as long as the lamp is in operation.

5. The circuit described in claim 4, wherein the positive-temperature-dependent resistor is replaced by a switch which is time-delayed in its response behavior.

6. The circuit described in claim 4, wherein the isolating switch is a four-layer diode (Sidac) having a punch-through voltage whose value is defined such that the four-layer diode is situated in its conductive condition in the time span between the turn-on of the power supply and the ignition of the lamp and is situated in its inhibited condition in the operating condition of the lamp.

7. The circuit described in claim 4, wherein the isolating switch is a circuit responsive to lamp light via an opto-electric semiconductor transducer.

8. An electronic circuit for the operation of a gas discharge lamp provided with heater coils, particularly a fluorescent lamp, whereby a high-frequency ac voltage for operating the lamp is generated with an inverter from a dc voltage which is derived from a line ac voltage by rectification, said lamp being arranged parallel to an effective capacitance of a series-resonant circuit formed of an effective capacitor and of an inductor and which includes the heater coils of the lamp, and whereby, during the heating-up operation of the heater coils (starting interval phase) between the turn-on of the power supply and the ignition of the lamp, the voltage adjacent thereto is limited to a value below its ignition voltage, said electronic circuit comprising:

a current branch representing the variable, effective capacitance in series with an isolating switch, said current branch having a parallel circuit of a series circuit of a first capacitor and a negative-temperature-coefficient resistor with a second capacitor;

wherein following the ignition of the lamp, the series-resonant circuit is suppressed by interrupting the current branch comprising the effective capacitance and lying parallel to the lamp, said current branch being interrupted by means of the isolating switch and remaining suppressed as long as the lamp is in operation.

9. The circuit described in claim 8, wherein the negative-temperature-dependent resistor is replaced by a switch which is time-delayed in its response behavior.

10. The circuit described in claim 8, wherein the isolating switch is a four-layer diode (Sidac) having a punch-through voltage whose value is defined such that the four-layer diode is situated in its conductive condition in the time span between the turn-on of the power supply and the ignition of the lamp and is situated in its inhibited condition in the operating condition of the lamp.

11. The circuit described in claim 8, wherein the isolating switch is a circuit responsive to lamp light via an opto-electric semiconductor transducer.

* * * * *